US005494003A

United States Patent [19]

Bartz et al.

[11] Patent Number: 5,494,003

[45] Date of Patent: Feb. 27, 1996

[54] WATER HEATER WITH PERFORATED CERAMIC PLATE INFRARED BURNER

[75] Inventors: David Bartz, Santa Clara; Martin G. Carswell, San Jose, both of Calif.

[73] Assignee: Alzeta Corporation, Santa Clara, Calif.

[21] Appl. No.: 299,360

[22] Filed: Sep. 19, 1994

[51] Int. Cl.[6] ..... F22B 5/00

[52] U.S. Cl. ..... 122/17; 122/14; 431/328

[58] Field of Search ..... 126/361; 122/13.1, 122/16, 17, 14, 19

[56] References Cited

U.S. PATENT DOCUMENTS 5,355,841 10/1994 Moore et al. ..... 126/361

*Primary Examiner*—Ira S. Lazarus
*Attorney, Agent, or Firm*—Paul W. Garbo

[57] ABSTRACT

A water heater of simplified construction which incorporates a unique infrared gas burner performs with notable thermal efficiency and suppression of the combustion pollutants, nitrogen oxides. The upright cylindrical water tank of the new water heater is supported by a cylindrical metal skirt having the same diameter of the tank. A circular perforated ceramic plate is fitted transversely in the skirt to provide a combustion zone above it and a plenum for fuel gas and air below it. A venturi tube extends through the skirt into the plenum for the injection of gas and air. The flameless combustion occurring at the exit surface of the perforated plate makes it a radiant emitter of infrared energy aimed at the bottom of the water tank.

9 Claims, 1 Drawing Sheet

WATER HEATER WITH PERFORATED CERAMIC PLATE INFRARED BURNER

BACKGROUND OF THE INVENTION

This invention relates to an improved water heater equipped with an infrared gas burner formed by a perforated ceramic plate.

Residential and commercial water heaters are commonly provided by a vertical cylindrical water tank with a gas burner below the tank. While the burner has been designed in several forms, all the burners found in conventional water heaters burn the gas with a flame; as known, flame-type burners receive combustion air partially as primary air that is inspirated by the gas stream and partially as secondary air that flows into the flame.

In spite of the many years during which conventional water heaters have been undergoing improvement, there is still a need for improving combustion to minimize the formation of air-polluting nitrogen oxides ($NO_x$), and for simplifying the construction of the water heater to reduce its cost.

As far back as September, 1963, Research Bulletin 97 (32 pages) was issued by American Gas Association Laboratories on Some New Or Unusual Methods For Heating Water With Gas. Bulletin 97 included tests on infrared burners which are commonly referred to as flameless burners and which receive all of the combustion air as primary air. The infrared burners were formed by triple layers of nickel stainless steel screen as the burner face attached to a pan-type burner body with one or two venturi injection tubes attached to the bottom of the pan-type body. Warpage of the screens was encountered and this led to flashback. Another problem was the flow of heat from the radiant screens to the metal pan-type burner body. Carbon monoxide measurements of the combustion products were in the several 100 parts per million range. There were no $NO_x$ measurements. Thirty years later, the marketplace still lacks a water heater featuring an infrared burner capable of yielding combustion products or flue gas containing very low levels of air-polluting $NO_x$.

A principal object of this invention is to provide a water heater with an infrared gas burner capable of producing a flue gas containing very small amounts of $NO_x$.

Another important object is to provide a durable infrared burner of simple construction.

A further object is to integrate the construction of the water heater and the infrared burner thereof to achieve overall economies of manufacture.

These and other objects and advantages of the invention will be evident from the description which follows.

SUMMARY OF THE INVENTION

In accordance with this invention, an improved water heater having an upright water tank is equipped with an infrared gas burner formed with a perforated ceramic plate and positioned below the water tank. The perforated ceramic plate which provides the burner face on which flameless combustion takes place is set in a skirt extension of the water tank so that the resulting radiant burner faces the bottom of the tank. The water tank has a central flue pipe extending therethrough and sealed to the top and bottom ends of the tank. Besides providing a duct for the discharge of the combustion products, the flue pipe helps to transfer heat from the combustion products to the water in the tank.

An essential element of the invention is the use of a perforated ceramic plate as the infrared burner incorporated below the water tank. The perforated ceramic plate avoids the several problems encountered with infrared burners formed with metal screens, such as warping of the screens and flashback, flow of heat to burner body, costly alloys required for the screens and poor durability.

The perforated ceramic plate used pursuant to this invention has been produced in numerous forms as disclosed in patents and technical publications. A commercially available perforated ceramic plate is shown in U.S. Pat. No. 3,954,387 to Cooper, and features a combustion surface in the form of square pyramids. U.S. Pat. No. 3,683,058 to Partiot presents a perforated ceramic plate of high radiation efficiency. While the specially designed perforated ceramic burner plates of these and other patents may be used pursuant to this invention, it is preferable in the interest of minimizing cost, to use a plate of simple configuration. For example, a flat sheet of ceramic fibers bonded together by a noncombustible binding agent as taught by U.S. Pat. No. 4,041,199 to Cartwright or any of the several patents cited thereagainst may be made into a burner plate suitable for the water heater of this invention. Such a ceramic sheet, about 0.5-inch thick, can be perforated to provide small holes in the diameter range of about 0.04 to 0.10 inch, preferably 0.06 to 0.08 inch, and uniformly spaced from one another, so that the total area of the holes is at least 25% of the ceramic sheet area used as the burner plate. The perforation can be carried out by drilling the ceramic sheet or by casting the sheet in a mold equipped with pins of the diameter and spacing corresponding to the holes desired in the finalized perforated ceramic burner plate, or by casting the ceramic sheet and impressing the desired perforations before the sheet has lost plasticity.

Regardless of the selected configuration of the perforated ceramic burner plate, it must have a sufficiently low pressure drop that natural gas at a water-column pressure of 4 inches flowing into a venturi tube below the plate will inspirate the combustion air in an amount at least 110% of the stoichiometric requirement. The resulting flameless combustion at the exit surface of the burner not only maintains that surface radiant and an effective emitter of infrared radiation directed at the bottom of the upright water tank but also yields a flue gas with a remarkably small content of air-polluting $NO_x$.

Another noteworthy feature of the invention is that the conventional blue flame burner body in the form of a metal casting or fabricated from metal stampings has been eliminated. This elimination is achieved by placing the perforated ceramic plate in a metal skirt extending from the cylindrical water tank and supporting the tank with its bottom spaced from the floor on which the water heater will be set.

The perforated ceramic plate is a circular disk that is spaced from the bottom of the water tank and extends fully across the inside diameter of the metal skirt support for the water tank. A venturi tube extends through the metal skirt at a level below the perforated ceramic plate. A gas nozzle positioned at the entrance of the venturi tube serves to supply fuel gas to the burner plate and to inspirate combustion air in an amount equal to at least 110%, preferably at least 130%, of the stoichiometric requirement. A shallow circular metal pan has a diameter that allows the metal skirt of the water heater to slip snugly there into and thus close the open bottom end of the skirt.

Thus, the lowermost portion of the metal skirt between the perforated ceramic burner plate and the metal pan forms a sealed plenum for the gas and air supplied thereto via the venturi tube. In turn, the gas-air mixture flows therefrom solely through the perforations of the burner plate into the combustion zone between that plate and the bottom of the water tank. The combustion zone is sealed against the entry of secondary combustion air except for small air leakage (not more than 5% of the primary air supplied to the burner) principally resulting from a small hole in the metal skirt for the admission of air to support a pilot flame above the burner plate.

The perforated ceramic burner plate selected for the water heater of this invention is characterized by a very low pressure drop that permits natural gas injected into a venturi tube at a pressure as low as a water column of 4 inches to inspirate primary combustion air in an amount equal to at least about 110% of the stoichiometric requirement. As a burner, a ceramic plate has several advantages over metal screens, including rigidity, low thermal conductivity, low thermal expansion and resistance to corrosion. These advantages are essential to the success of the invention in that the circular plate or disk required as the burner is generally at least 14 inches in diameter and must resist sagging, warping and loss of strength at elevated temperatures.

BRIEF DESCRIPTION OF THE DRAWINGS

To facilitate the further description and understanding of the invention, reference will be made to the accompanying drawings of which.

DESCRIPTION OF A PREFERRED EMBODIMENT

Figure 1:
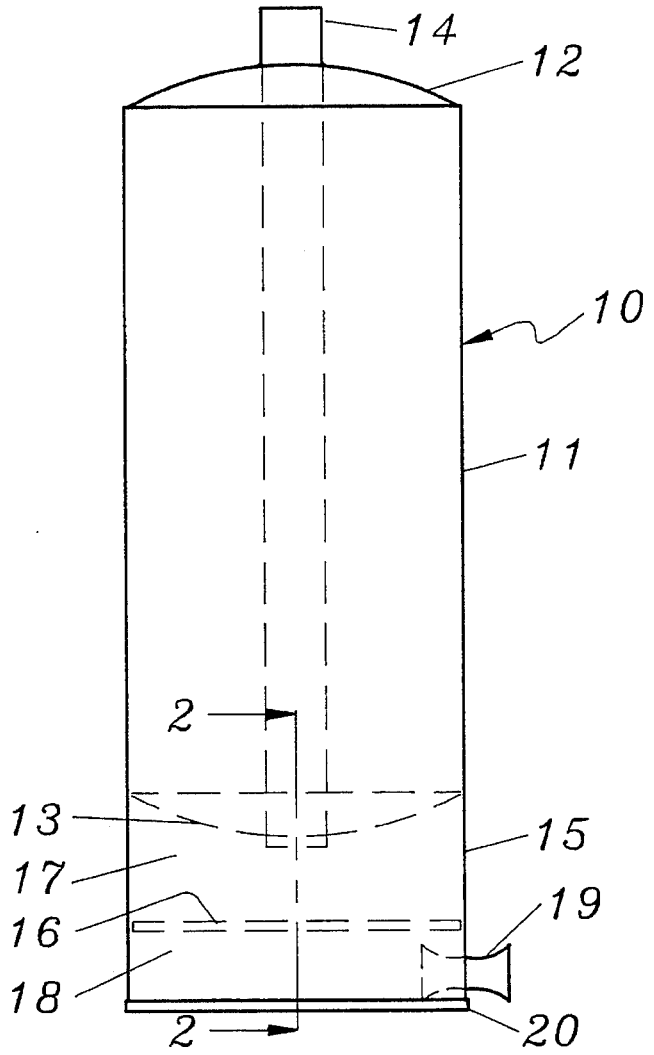
FIG. 1 is a diagrammatic elevation of the water heater of this invention.

FIG. 1 is a diagrammatic elevation showing the arrangement of the principal elements of the water heater 10 of this invention. Water heater 10 comprises cylindrical water tank 11 having dish end 12 at the top and dish end 13 at the bottom; flue pipe 14 extending through and welded to bottom dish 13 and rising through water tank 11 and top dish 12 to which is welded; metal skirt 15 which in effect is an extension of the cylindrical wall of water tank 11 beyond bottom dish 13; a perforated ceramic burner plate 16 fitted in skirt 15 to act as a divider between upper combustion zone 17 and lower plenum 18; venturi tube 19 extending through skirt 15 for the injection of fuel gas and inspirated combustion air into plenum 18; and pan 20 that closes the bottom of skirt 15 and plenum 18.

The operation of the water heater simply involves injecting natural gas or like fuel from a nozzle (not shown) into venturi tube 19 to inspirate air and fill plenum 18 with a fuel-air mixture that upon passing through perforated plate 16 is ignited by a small pilot flame (not shown) above plate 16. The resulting flameless combustion not only makes the exit surface of plate 16 a radiant emitter of infrared energy directed at bottom dish 13 of tank 11 but also yields a flue gas with a remarkably low content of $NO_x$. The hot flue gas flows from combustion zone 17 up flue pipe 14 and transfers heat to the water in tank 11.

Figure 2:
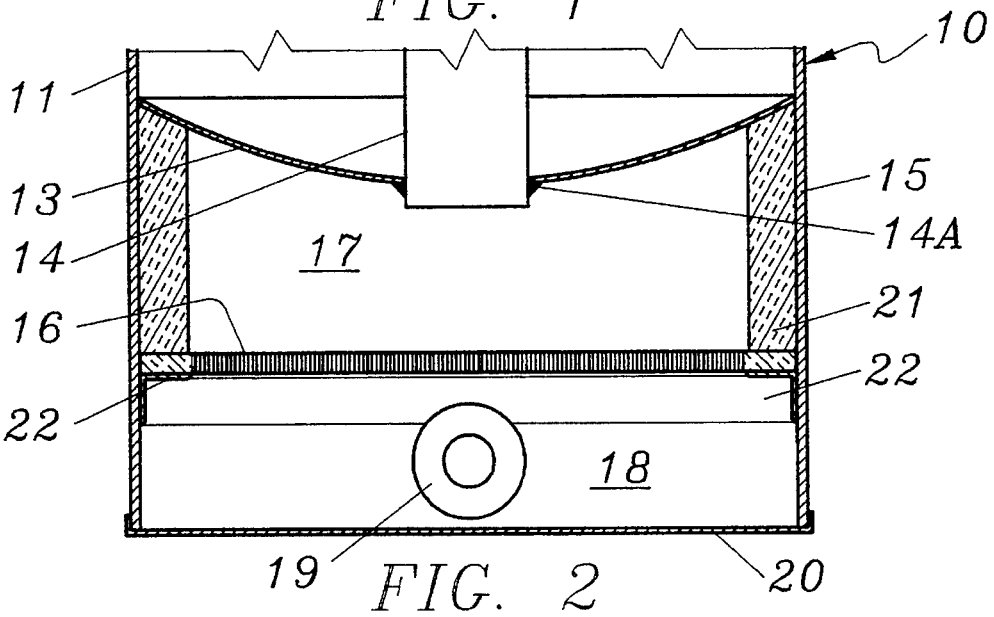
FIG. 2 is a more or less diagrammatic sectional elevation of the bottom portion of the new water heater, taken along the line 2—2 of FIG. 1.

FIG. 2 is a diagrammatic sectional elevation of all the elements, except flue pipe 14, in the lower portion of water heater 10. Skirt 15 is shown as an integral extension of the cylindrical wall of water tank 11. Bottom dish 13 of tank 11 is positioned within, and welded to the inner side of the cylindrical wall of water tank 11. Flue pipe 14 fits in a central hole in dish 13 and is fastened thereto by weld 14A. Combustion zone 17 has a layer 21 of furnace-type insulation lining the portion of skirt 15 that surrounds zone 17. Perforated ceramic burner plate 16 is fitted into skirt 15 with its periphery held against insulation layer 21 by angle-iron ring 22 which is fastened to skirt 15 by bolts (not shown) or other known means. The portion of skirt 15 between burner plate 16 and bottom pan 20 provides plenum 18 into which a gas-air mixture is injected through venturi tube 19.

For the clear presentation of the invention, well-known structural details of water heaters have been omitted. Therefore, it is obvious that the skilled worker needs no instructions on providing such basic elements as a pilot flame near the exit face of burner plate 16 or surrounding the water heater with a jacket of thermal insulation.

In spite of the outstanding simplicity and economy of manufacture, the water heater of the invention operates with a thermal efficiency and suppression of air-polluting $NO_x$ which are truly impressive when compared with water heaters sold currently.

Specifically, a standard 40-gallon water heater with a 4-inch central flue, currently marketed by the leading manufacturers, was used in comparative tests conducted at a firing rate of about 40,000 British Thermal Units per hour. As shown in FIG. 1, the cylindrical wall of the water tank extended beyond the bottom end of the tank to provide a cylindrical skirt as the support for the tank which was surrounded with 1 inch of foam insulation.

The U.S. Department of Energy standard 24-hour test of overall efficiency was conducted on the 40-gallon water heater with its conventional blue flame burner formed by two circular (6 inch diameter) metal stampings: an upper member that is essentially flat and a lower member that is dish-like with a central hole into the center of which natural gas at a pressure of 4 inches of water column was injected from an orifice positioned below the hole in the lower member to inspirate primary air. Both members had undulate peripheries and were held together so that the wave bottoms of the upper member rested on the wave tops of the lower member. Thus, the opposed undulate peripheries formed a series of contiguous quasi-elliptical apertures from which the injected gas issued and burned with the benefit of secondary air as a circular multiplicity of blue flames.

Tests with the standard water heater including its blue flame burner resulted in an energy factor (DOE) of 0.55 and in a flue gas containing 85 parts per million of $NO_x$.

The original blue flame burner was removed from the water heater and a perforated ceramic disk (16.5 inch-diameter and 0.5 inch-thick) was fitted as a transverse partition in the skirt, spaced 4 inches from the bottom of the water tank. The perforated disk was held in place by an angle iron ring as shown in FIG. 2. The perforated portion of the disk, formed of ceramic fibers bonded together by a silica-containing binder, which was not obstructed by the angle iron ring, was 13 inches in diameter. Perforations with a diameter of 0.078 inch were uniformly spaced from one another to provide a total perforation area equal to 33% of the 13 inch-diameter unobstructed portion of the ceramic disk that served as the novel burner in accordance with this invention.

The bottom and lateral openings of the skirt were sealed to prevent the entry of secondary air and a venturi tube passing radially through the skirt was installed to discharge into the 3 inch-space or plenum between the perforated ceramic burner and the sealed bottom of the skirt. The venturi tube was designed to inspirate 130% of the stoichiometrically required air when natural gas at a pressure of 4 inches of water column was injected thereinto. The gas-air mixture thus supplied via the venturi tube to the plenum below the perforated disk flows through the perforations and, upon ignition, maintains flameless combustion so that the discharge face of the ceramic disk burner becomes a radiant emitter of infrared energy directed to the bottom of the water tank.

Tests with the standard water heater after replacing the blue flame burner with the perforated ceramic burner, as described, resulted in an energy factor (DOE) of 0.60 and in a flue gas containing 5 parts per million of $NO_x$. These results demonstrate the clear superiority of the improved water heater with the infrared ceramic burner of this invention over the standard water heater currently supplied by leading manufacturers with the blue flame metal burner.

Modifications and variations of the water heater of this invention will be apparent to those skilled in the art without departing from the spirit and scope of the invention. The many patents for perforated ceramic plate infrared burners are certainly suggestive of variations. Accordingly, only such limitations should be imposed on the invention as are set forth in the appended claims.

What is claimed is:

1. An improved water heater comprising an upright cylindrical water tank, a flue pipe extending lengthwise through said tank and the opposite ends of said tank, said pipe being attached to said opposite ends, a cylindrical metal skirt of substantially the same diameter of said tank to support said tank, a circular perforated ceramic flat plate infrared gas burner fitted as a transverse partition in said skirt to provide a combustion zone above said burner and a plenum for gas and air below said burner, said ceramic plate having a diameter substantially equal to the inside diameter of said skirt and having perforations over its entire face except for a narrow rim portion by which it is supported in said skirt, furnace-type insulation surrounding said perforations as lining of said skirt between said rim portion and the bottom end of said tank and exposed to said combustion zone, a venturi tube extending through said skirt into said plenum for the supply of said gas and air thereto, and a pan across the bottom end of said skirt to seal the bottom of said plenum.

2. The improved water heater of claim 1 wherein the perforated ceramic flat plate infrared burner has perforations with a diameter in the range of about 0.04 to 0.10 inch, the total area of said perforations being equal to at least 25% of the area of the entire face of said burner except for its narrow rim portion by which it is supported.

3. The improved water heater of claim 2 wherein the perforated ceramic flat plate infrared burner is formed of ceramic fibers bonded together by a noncombustible binding agent and has a thickness of about 0.5 inch.

4. The improved water heater of claim 1 wherein the cylindrical wall of the water tank and the cylindrical metal skirt are formed by a single metal sheet rolled into a cylinder having the desired diameter of said tank.

5. In a water heater having an upright cylindrical water tank with a flue pipe extending therethrough, a cylindrical metal skirt extending downward from the cylindrical wall of said tank for the support thereof, said skirt having a closed bottom end, and a gas burner positioned within said skirt, the improvement comprising an infrared gas burner in the form of a circular perforated ceramic flat plate fitted in said skirt as a transverse partition spaced from the bottom of said tank to provide a combustion zone and spaced from said closed bottom end of said skirt to provide a plenum for fuel gas and air injected thereinto, said ceramic flat plate having a diameter substantially equal to the inside diameter of said skirt and having perforations over its entire face except for a narrow rim portion by which it is supported in said skirt, furnace-type insulation surrounding said perforations as lining of said skirt between said rim portion and the bottom end of said tank and exposed to said combustion zone, and a venturi tube extending through said skirt into said plenum for the injection of said fuel gas and air.

6. The improvement of claim 5 wherein the circular perforated ceramic flat plate has perforations with a diameter in the range of about 0.04 to 0.10 inch and the total area of said perforations is equal to at least 25% of the area of the entire face of said plate except for its narrow rim portion by which it is supported.

7. The improvement of claim 5 wherein the circular perforated ceramic flat plate is formed of ceramic fibers bonded together by a noncombustible binding agent.

8. The improvement of claim 7 wherein the circular perforated ceramic flat plate has a thickness of about 0.5 inch and the perforations of said plate have a diameter in the range of 0.06 to 0.08 inch and a total area equal to at least 25% of the area of the entire face of said plate except for its narrow rim portion by which it is supported.

9. The improvement of claim 8 wherein the cylindrical wall of the water heater and the cylindrical metal skirt are formed by a single metal sheet rolled into a cylinder having the desired diameter of said tank.

* * * * *